US011098490B2

(12) United States Patent
Baum

(10) Patent No.: US 11,098,490 B2
(45) Date of Patent: Aug. 24, 2021

(54) SELF-LIFTING CONCRETE FORM WITH PLATFORM ADAPTED TO ACCOMMODATE HORIZONTAL REINFORCING STEEL

(71) Applicant: Norton Baum, Inverness, IL (US)

(72) Inventor: Norton Baum, Inverness, IL (US)

(73) Assignee: Forming Concepts, Inc., Gilberts, IL (US)

( * ) Notice: Subject to any disclaimer, the term of this patent is extended or adjusted under 35 U.S.C. 154(b) by 430 days.

(21) Appl. No.: 15/598,059

(22) Filed: May 17, 2017

(65) Prior Publication Data

US 2018/0334815 A1 Nov. 22, 2018

(51) Int. Cl.

| | |
|---|---|
| ***E04G 11/28*** | (2006.01) |
| ***E04G 17/00*** | (2006.01) |
| *E04C 5/03* | (2006.01) |
| *E04B 5/32* | (2006.01) |
| *E04B 5/17* | (2006.01) |

(52) U.S. Cl.

CPC ..... *E04G 11/28* (2013.01); *E04G 17/002* (2013.01); *E04B 2005/176* (2013.01); *E04B 2005/324* (2013.01); *E04C 5/03* (2013.01)

(58) Field of Classification Search

CPC ..... E04G 11/30

See application file for complete search history.

(56) References Cited

U.S. PATENT DOCUMENTS 3,779,678 A 12/1973 Scheller
3,930,567 A * 1/1976 Sims ..... B28C 5/4251 193/10
3,973,885 A 8/1976 Schmidt
4,016,228 A 4/1977 Schmidt
4,040,774 A 8/1977 Scheller
4,917,346 A 4/1990 Mathis
5,198,235 A 3/1993 Reichstein et al.
(Continued)

FOREIGN PATENT DOCUMENTS

DE 2756390 A1 * 6/1979

*Primary Examiner* — Benjamin A Schiffman

(74) *Attorney, Agent, or Firm* — Erickson Law Group, PC

(57) ABSTRACT

A forming system includes a frame and two forming walls. The two forming walls are positioned at a distance from each other to define a first vertical wall course. One forming wall is supported by the frame such that the one forming wall can be translated toward or away from the respective other forming wall. The frame can be raised to raise the two forming walls to be positioned to pour a second vertical course on top of the first vertical course. The translation of the one forming wall allows for the pouring of the first vertical course with horizontally extending rebar that extends through the one forming wall outside of the first vertical wall course, to tie in to a subsequently poured floor slab. The translation permits the vertical raising of the one forming wall, without striking the extending rebar, to pour the second vertical course on the first vertical course. A worker's platform is provided that is supported by the frame and vertically movable by raising the frame. The worker's platform is located below the one forming wall on a side of the one forming wall opposite the respective other forming wall and is rollable or pivotal to also clear the extending rebar during raising of the frame.

10 Claims, 2 Drawing Sheets

(56) References Cited

U.S. PATENT DOCUMENTS

| | | | |
|---|---|---|---|
| 6,260,311 | B1 | 7/2001 | Vladikovic |
| 6,276,912 | B1 | 8/2001 | Rock |
| 6,557,817 | B2 | 5/2003 | Waldschmitt et al. |
| 8,020,271 | B2 | 9/2011 | Baum et al. |

* cited by examiner

SELF-LIFTING CONCRETE FORM WITH PLATFORM ADAPTED TO ACCOMMODATE HORIZONTAL REINFORCING STEEL

BACKGROUND OF THE INVENTION

When a concrete floor slab intersects a vertical concrete wall in most cases reinforcing steel will stick out of the vertical wall. This steel will later be poured into the intersecting concrete slab. This is done to ensure a good joint and no movement between the vertical wall and the concrete floor. However, this reinforcing steel creates an obstruction to direct vertical movement of the concrete formwork for the next course of the vertical wall.

Previously, either the floor and the wall were poured together, forcing the progress of the vertical walls to be dependent on the progress of the floor slabs, or an expensive reinforcing dowel bar substitute would be placed in the area where the reinforcing was to intersect the concrete slab. These methods are labor intensive and the dowel bar substitute itself is expensive.

The present inventor has recognized that the formwork for the vertical wall must allow for the penetration of the reinforcing steel or rebar and be able to be moved back quickly and easily for multiple reuses. The form must be able to clear the protruding reinforcing steel to be raised to pour a next course.

The present inventor has recognized that scaffold that is part of the self-rising system must allow for the protruding reinforcing steel to pass as the concrete formwork is lifted.

The present inventor has recognized that scaffold access must still be maintained in order to work on the form during the construction sequence.

The present inventor has recognized that a need exists to allow the vertical concrete wall course to be poured and allow protruding rebar for a floor to be poured but still allow the concrete form to be easily stripped and lifted with the current self-lifting forms systems in the market place.

SUMMARY

The exemplary embodiment apparatus of the invention includes two forming walls that are positioned at a distance from each other to define a thickness of a vertical structure, such as a wall, to be filled or poured with concrete. At least one of the walls is supported by a frame such that the wall can be translated toward or away from the respective other wall. The apparatus can include a frame wherein the two forming walls are hung from the frame and one of the walls is hung with a rolling connection to be translated toward or away from the respective other wall. The frame can be provided with motive means for raising the forming walls to pour a course or level on top of a previously poured concrete course. The apparatus allows for the pouring of a course having horizontally extending rebar to tie in a floor slab to that course and for the vertical raising of the apparatus to pour a next course on the previously poured course without interference of the apparatus with the extending rebar. To this end, one of the walls that is adjacent to the extending rebar is movable horizontally away from the respective other wall by a distance sufficient to clear the extending rebar.

A workers platform is retractable or foldable to also clear the extending rebar. A forming strip is positioned onto the moving wall to form around the extending rebar and forms part of the forming surface of the movable wall.

When the movable wall is moved away from the respective other wall after the poured concrete between the walls has sufficiently set or cured, the forming strip detaches from the movable wall and is thereafter stripped off of the cured concrete wall and from around the extending rebar.

Numerous other advantages and features of the present invention will become readily apparent from the following detailed description of the invention and the embodiments thereof, and from the accompanying drawings.

DETAILED DESCRIPTION

Figure 2:
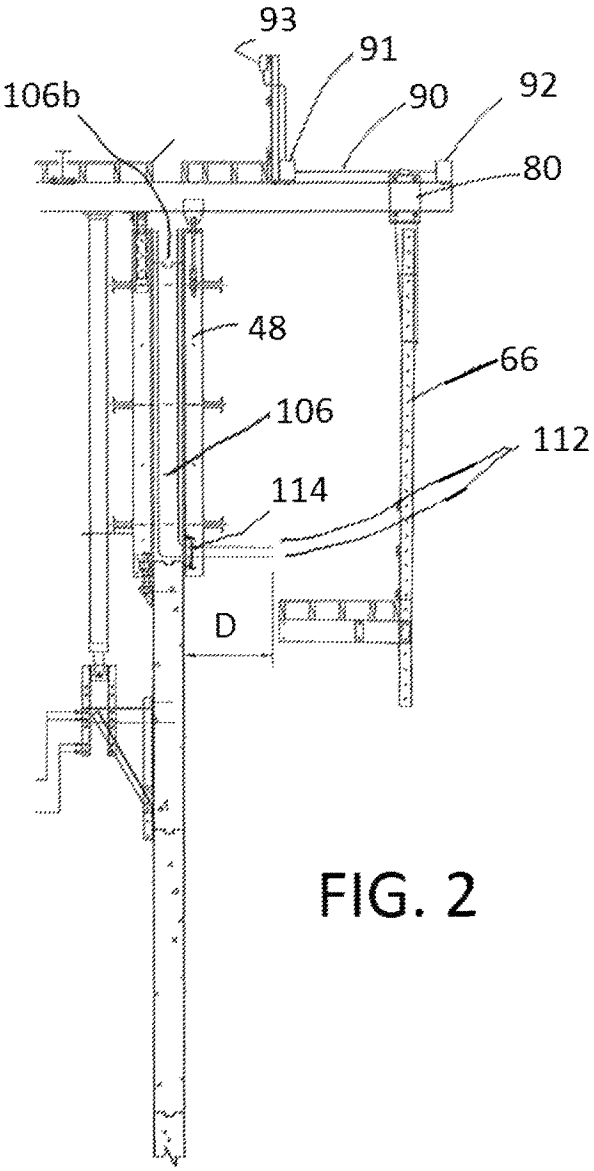
FIG. 2 is a sectional view of the self-raising concrete form apparatus of FIG. 1 in a state wherein a worker platform has been retracted to the right to clear horizontal rebar.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

This application incorporates by reference U.S. Pat. No. 9,611,663 for "Self-Lifting Concrete Form Adapted To Accommodate Horizontal Reinforcing Steel" and U.S. Pat. No. 8,020,271 for "Self-Raising Form Control System and Method."

Figure 1:
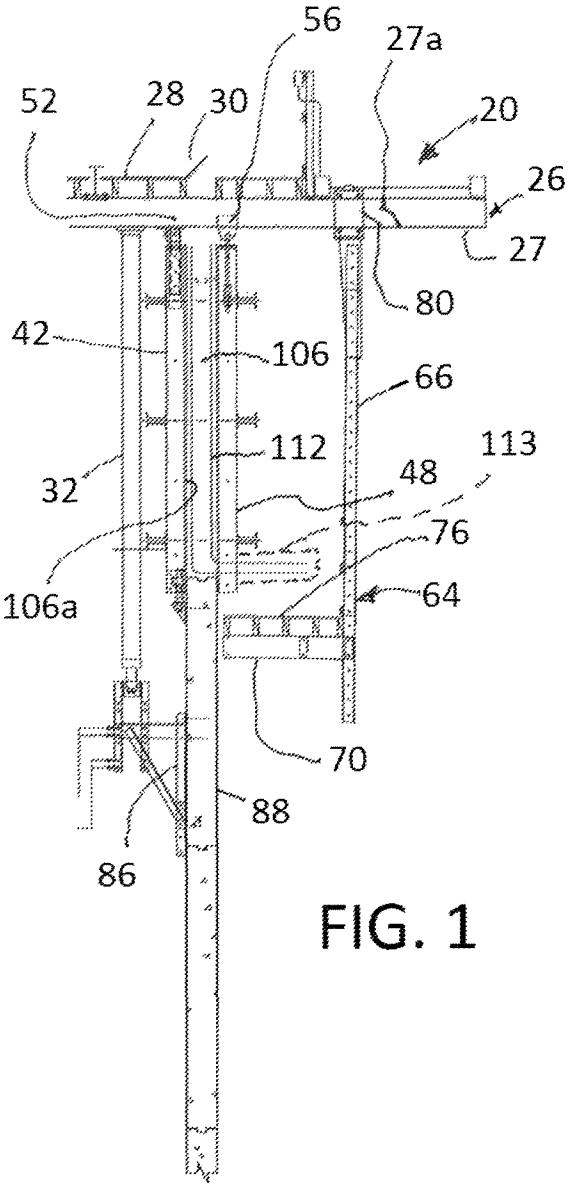
FIG. 1 is a sectional view of a self-raising concrete form apparatus incorporating a first embodiment of the invention.

FIGS. 1 and 2 illustrate a self-raising concrete form system 20 that is particularly useful in forming elevator and stair cores in high-rise buildings but can also be useful in other concrete forming operations.

The system includes a frame 26 that has beams 27 supported by a plurality of hydraulic jacks 32. The platform 26 includes an upper platform deck 28 and appropriate railings. A cover 30 can be lifted or pivoted giving access through the platform deck 28 to the work below.

A first forming wall 42 is fixedly hung from the beams 27 at a connection 52. A second forming wall 48 is hung from the beams 27 using a rolling connection 56. The rolling connection includes wheels that roll along a bottom flange 27*a* of the beam 27. The second wall 48 can be rolled toward and away from the first wall 42. A work platform assembly or scaffold 64 is hung from the frame 26. The scaffold includes at least one vertical members 66 that supports a horizontal support frame 70. A platform 76 is supported on the support frame 70. The vertical member 66 is supported on the beam 27 and includes a rolling connection 80. The rolling connection 80 includes wheels to roll along the bottom flange 27*a* of the beam 27.

The jacks 32 are supported by brackets 86 that are fastened to a previously poured course or level or vertical section 88.

The state or position of the apparatus 20 in FIG. 1 is after a second course 106 is poured onto the previous course 88.

Vertical and horizontal reinforcing steel or rebar (not shown) is set within a volume 106*a* that is to be poured with concrete to cast the course 106 (as is known). Additionally, L-shaped rebar 112 is set within the volume 106*a* that defines the course 106 and extend horizontally for a distance "D" for the purpose of tying the vertical course 106 after being poured with an adjacent to-be-poured concrete floor slab 113. The platform 76 is arranged a short distance below the wall 48 to give workers a working platform to place rebar and prepare the rebar for pouring the course 106.

The second wall 48 has been rolled via the connection 56 toward the first wall 42 until the distance between the walls 42, 48 corresponds to the desired thickness of the course 106. The course 106 has been poured with a top keyway 106*b* formed by an elongated form block. Typically, rebar (not shown) would extend up through the top of the course 106 to tie the course 106 with the next course to be poured on top of the course 106.

In order to accommodate the rebar 112 extending out of the side of the volume 106*a* between the walls 42, 48, a forming strip 114 (shown schematically) forms part of the wall 48. The forming strip 114 can be plywood, a wood plank, expanded metal or some other material. The forming strip 114 is provided with holes for passing the horizontal legs of the rebar 112 therethrough.

The forming strip 114 will most likely be somewhat bound to the rebar 112 after the poured concrete sets and it is anticipated that a new forming strip 114*a* will be needed for each new course and the previous forming strip 114 will need to be stripped from the rebar 112 and the previous course, before a floor slab is poured around the rebar 112.

FIG. 2 illustrates the scaffold 64 has been rolled to the right by the wheels of the rolling connection 80, rolling on the flange 27*a*. The platform 76 is moved at least the distance D to clear the horizontal rebar to accommodate vertical movement of the form system 20.

The rolling connection 80 is driven by a cable 90 fixed to the rolling connection 80. The cable is moved to the right from a box 91, to a box 92 by an electrically driven winding arrangement. The cable shown can be part of an endless loop that is circulated by a sprocket or pulley, driven in rotation by a motor in a forward or reverse direction of circulation depending on which direction the scaffold 64 is to be moved.

The cable 90 can be replaced by a chain drive or a screw drive or a hydraulic cylinder or any other known means of translation movement. A button operated switch 93 controls movement of the cable 90.

At a time after, before, or simultaneously with the movement of the scaffold 64, the wall 48 is moved to the right by the wheels of the rolling connection 56, rolling on the flange 27*a*. The wall 48 is moved to the right a sufficient distance to clear the horizontal rebar protruding from the course 106 after the concrete has sufficiently cured.

After both the wall 48 and the scaffold 64 have moved to the right (as shown in FIGS. 1 and 2), a sufficient distance to clear the horizontal rebar 112, the system 20 can be moved upward by the jacks 32 to prepare for forming the next course.

Although FIGS. 1 and 2 illustrate a sectional view of the apparatus in only the two dimensional plane of the page, it is to be understood that some members extend into the page, such as the walls 42, 48, the strip 114, the sections 88, 106, the support frame 70 and the platform 76, and that other members represents not only one member in the plane of the page but a row of like members spaced-apart, in appropriate spacing into the page, such as the beams 27, the corresponding connections 52, 56, the rebar 112, the jacks 32, and the vertical member 66.

Figure 4:
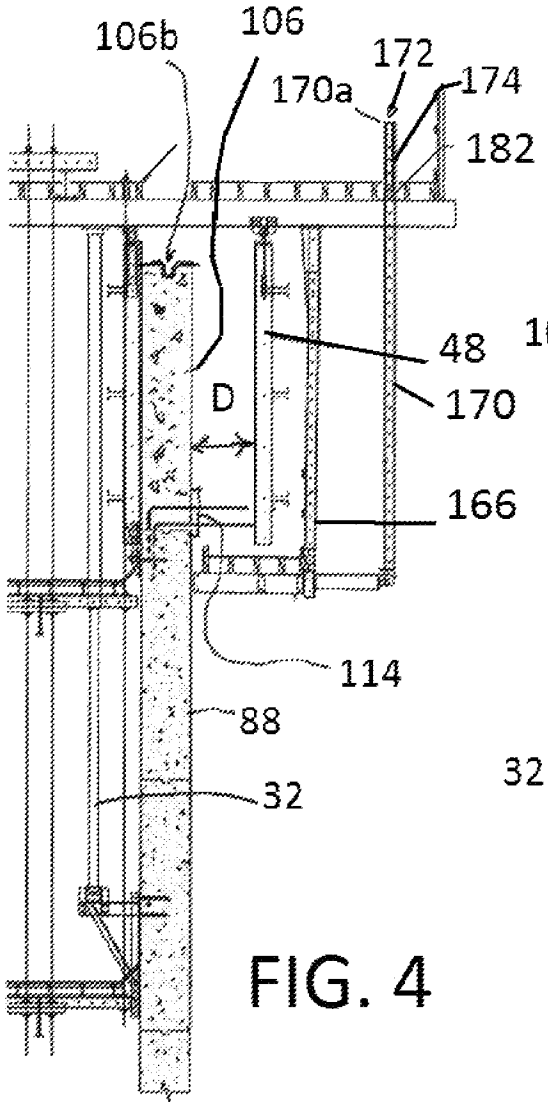
FIG. 4 is a sectional view of the self-raising concrete form apparatus of FIG. 3 in a state wherein the course is formed and poured and one forming wall has been moved away from the course.

A typical construction sequence can be:

self-lifting concrete form is erected;

the scaffold 64 is moved into operating position (see position in FIG. 1);

the movable forming wall 48 is spaced from the stationary wall 42 (see position in FIG. 4).

a replaceable forming strip 114 is installed in the moving forming wall 48;

reinforcing steel 112 is installed protruding through the replaceable strip 114;

the moving wall 48 is moved toward the wall 42;

concrete is poured between the walls 42, 48;

after the concrete is sufficiently set, the forms are moved, stripped or retracted;

the moving wall 48 is moved back, leaving the protruding reinforcing steel 112 and the replaceable forming strip 114 in place;

the scaffold 64 is retracted in order to clear the protruding reinforcing steel 112;

operating personnel can stand on the platform 76 while this step is performed;

once the protruding reinforcing steel 112 is clear of the moving forming wall 48 and the platform 76, the self-lifting form is operated and lifted to the next course;

once at the next course, the self-lifting concrete form is anchored and aligned for the next pour;

another replaceable strip 114*a* is put in place in the moving forming wall 48 and the sequence is repeated; and prior to pouring the concrete floor slab 113, the replaceable strip 114 that was previously poured against, is removed from the protruding reinforcing steel 112.

Figure 5:
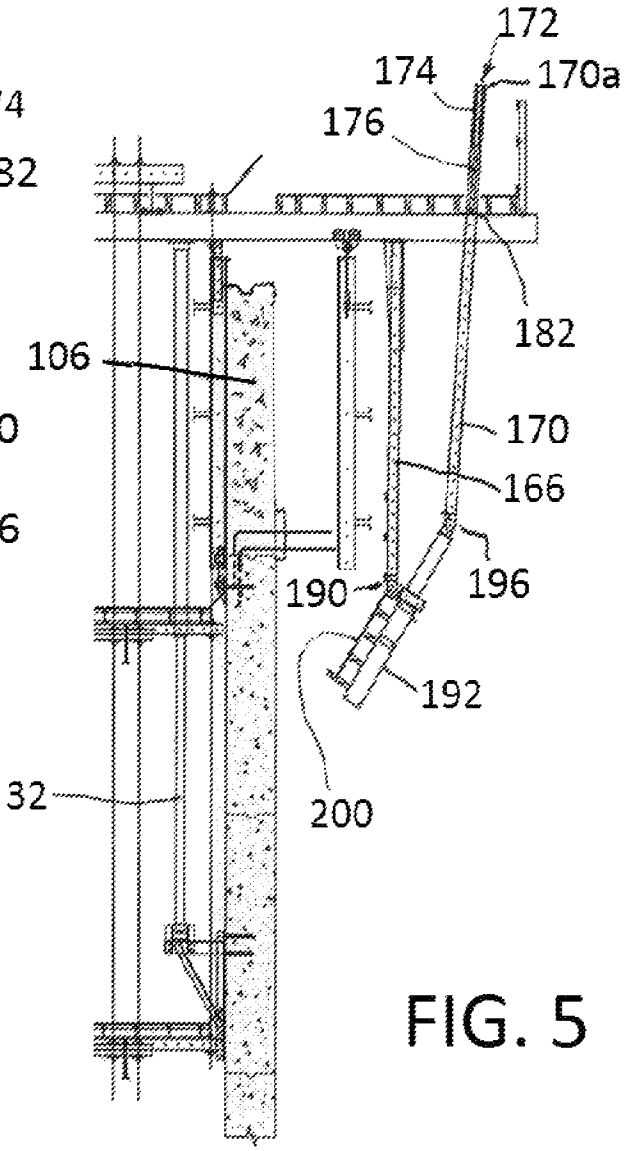
FIG. 5 is a sectional view of the self-raising concrete form apparatus of FIG. 4 in a state wherein a worker platform has been pivoted downward to clear horizontal rebar.
Figure 3:
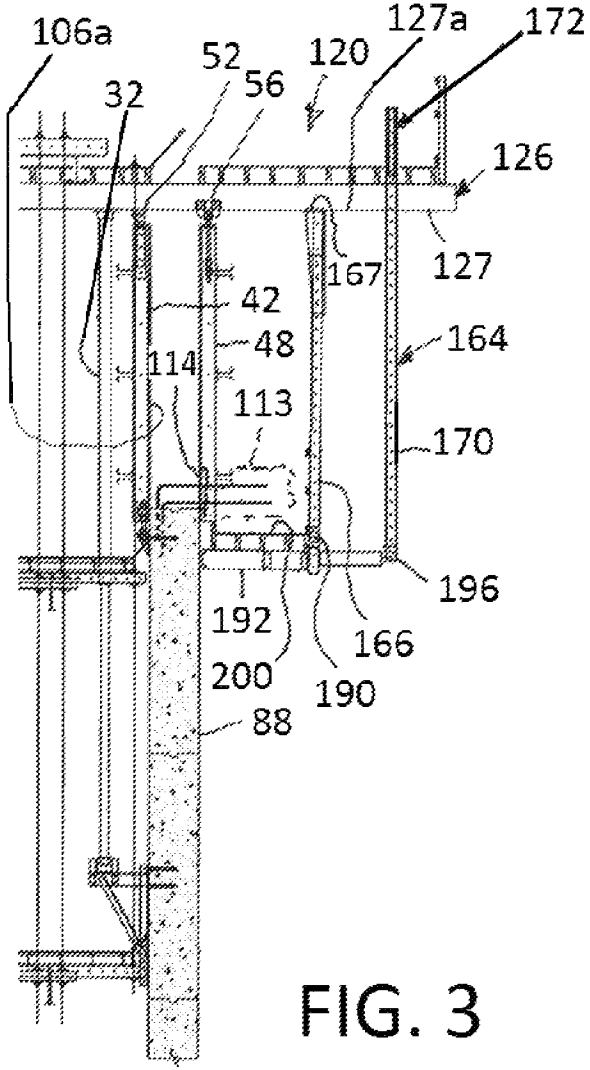
FIG. 3 is a sectional view of an alternate embodiment of a self-raising concrete form apparatus of the invention in a state wherein a next course is being prepared for forming.

FIGS. 3-5 illustrate an alternate self-raising concrete form system 120. Many of the components are identical to those incorporated into the system 20 of FIGS. 1 and 2 and like component are indicated by the same reference number.

The system includes a frame 126 that has beams 127 supported by a plurality of hydraulic jacks 32. The first forming wall 42 is fixedly hung from the beams 127 at the connection 52. The second forming wall 48 is hung from the beams 127 using the rolling connection 56 having wheels which roll on the lower flange 127*a* of the beams 127. The second wall 48 can be rolled toward and away from the first wall 42.

A work platform assembly or scaffold 164 is hung from the frame 126. The scaffold 164 includes a first vertical member 166 fixed to the beam 127 by a fixed connection 167. A second vertical member 170 is supported by the beam 127 by a hydraulic or pneumatic cylinder 172. The hydraulic or pneumatic cylinder 172 has a cylinder body 174 connected to a top end portion 170*a* of the second vertical member 170 that is above the beam 127, and an extendable rod 176 is pivotally connected to the beam 127 by a pivotal connection 182. The second vertical member is substantially free to raise and lower or pivot, being only constrained by the connection to the hydraulic or pneumatic cylinder 172, and by a connection at its lower end, described below. The hydraulic or pneumatic cylinder 172 can lengthen and pivot, and which alone supports the second vertical member 170 at the top end portion thereof.

The first vertical member 166 is pivotally connected at its lower end by a pivotal connection 190 to a support frame 192. The second vertical member 170 is connected at its lower end to the support frame 192 by a pivotal connection 196. A platform or deck 200 is connected to and supported by the frame 192.

The state or position of the apparatus 120 in FIG. 3 is before a second course 106 is poured onto the previous course 88. Vertical and horizontal reinforcing steel or rebar (not shown) is set within a volume 106*a* that is to be poured with concrete to cast the course 106 (as is known). Additionally, L-shaped rebar 112 is set within the volume 106*a* and extend horizontally for the distance "D" for the purpose of tying the vertical course 106 after being poured, with an adjacent to-be-poured concrete floor slab 113.

The second wall 48 has been rolled via the connection 56 toward the first wall 42 until the distance between the walls 42, 48 corresponds to the desired thickness of the course 106. The course 106 has been poured with a top keyway 106*b* formed by an elongated form block. Typically, rebar (not shown) would extend up through the top of the course 106 to tie the course 106 with the next course to be poured on top of the course 106.

The platform 200 is in position beneath the rebar 112 and the wall 48 at a short distance below the wall 48 to allow workers to place and manipulate rebar within the volume 106*a*.

In order to accommodate the rebar 112 extending out of the side of the volume 106*a* between the walls 42, 48, a forming strip 114 (shown schematically) forms part of the wall 48. The forming strip 114 can be plywood, a wood plank, expanded metal or some other material. The forming strip 114 is provided with holes for passing the horizontal legs of the rebar 112 therethrough.

The forming strip 114 will most likely be somewhat bound to the rebar 112 and the concrete after the concrete cures and it is anticipated that a new forming strip 114*a* will be needed for each new course and the previous forming strip 114 will need to be stripped from the rebar 112 and the previous course before a floor slab 113 is poured around the rebar 112.

FIG. 4 illustrates that the course 106 has been completed. In order to raise the apparatus, non-interference with the extending horizontal legs of the rebar 112 must be accomplished. The second wall 48 has been rolled back away from the course 106 by a distance greater than "D" the exposed horizontal length of the rebar 112. The platform 200 remains in place for the workers.

FIG. 5 illustrates that the hydraulic or pneumatic cylinder 172 has been pressurized to extend the rod 176 from the body 174, effectively lengthening the hydraulic or pneumatic cylinder 172. By this action the vertical member 170 is raised, and the support frame 192, with the platform 200, pivots downwardly about the connection 196. The support frame 192, with the platform 200, can be pivoted down to an even greater extent than shown in FIG. 5 such that it vertically clears the extending rebar 112 and the system 120 can be raised to form the next course on top of the course 106.

At the appropriate time thereafter, the floor 113 can be poured with concrete, surrounding and incorporating the extending horizontal rebar 112.

Because of geometry, the vertical member 170 moves upward and also pivots slightly about the pivotal connection 182 as the cylinder 172 is extended in length under hydraulic or pneumatic pressure.

Although FIGS. 3-5 illustrates a sectional end view of the apparatus in only the two dimensional plane of the page, it is to be understood that some members extend into the page, such as the walls 42, 48, the strip 114, the poured concrete sections 88, 106, the support frame 192, and the platform 200, and that other members represents not only one member in the plane of the page but a row of like members spaced-apart, in appropriate spacing into the page, such as the beams 127, the corresponding connections 52, 56, the rebar 112, the jacks 32, the vertical members 166, 170, the connections 190, 196, 182, the cylinders 172 and the jacks 32.

A typical construction sequence can be:

self-lifting concrete form system 120 is erected;

the platform 200 is in operating position (see the position in FIG. 3) a replaceable forming strip 114 is installed in the movable forming wall 48;

reinforcing steel or rebar 112 is installed protruding through the replaceable strip 114;

the moving forming wall 48 is moved toward the wall 42 to form a volume 106*a* for the course;

concrete is poured between the walls 42, 48;

after the concrete is sufficiently cured, the forms are moved, stripped or retracted;

the moving wall 48 is moved back leaving the protruding reinforcing steel 112 and the replaceable forming strip 114 in place (see the position in FIG. 4);

platform 200 is rotated downward using the cylinders 172 in order to clear the protruding reinforcing steel 112;

once the protruding reinforcing steel 112 is clear of the moving forming wall 48 and all the platform 200, the self-lifting form is operated and lifted to the next course;

once on the next course the self-lifting concrete form is anchored and aligned for the next pour;

another replaceable strip 114*a* is put in place in the moving forming wall 48 and the sequence is repeated; and prior to pouring the concrete floor slab 113, the replaceable strip 114 that was previously poured against, is removed from the protruding reinforcing steel 112.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A forming system for forming a wall and tying a subsequently poured floor to the wall by horizontal rebar, comprising:

a frame;

two forming walls that are positioned at a distance from each other to define a thickness of a vertical void to be filled with concrete to form a first vertical wall course, one forming wall of the two forming walls is supported by the frame such that the wall can be translated toward or away from the respective other forming wall of the two forming walls, the frame can be raised to raise the two forming walls to be positioned to pour a second vertical course on top of the first vertical wall course, wherein the translation of the one forming wall allows for the pouring of the first vertical wall course having horizontally extending rebar that extends outside of the first vertical wall course to tie in a floor slab to the first vertical wall course, and for the vertical raising of the two forming walls to pour the second vertical wall course on the first vertical wall course without interference of the vertical movement of the one forming wall with the extending rebar, wherein the one forming wall is movable horizontally away from the respective other forming wall by a distance sufficient to clear the extending rebar;

a worker's platform supported by the frame and vertically movable by raising the frame, the worker's platform located below the one forming wall when deployed for use and substantially on a side of the one forming wall opposite the respective other forming wall, wherein the worker's platform is retractable to also clear the extending rebar; and the worker's platform supported by a first member and a second member, the first and second members supported from the frame, the first member pivotally connected to the worker's platform at a first position located below the one forming wall, and the second member pivotally connected to the worker's platform at a second position that is spaced from the first position and further from the one forming wall than the first-position, wherein the raising of the second member without raising the first member causes the platform to pivot downward about the first position to vertically clear the horizontal rebar allowing vertical movement of the worker's platform without interference with the horizontal rebar.

2. The forming system according to claim 1, comprising a linear actuator, wherein the first member is fixedly supported from the frame and the second member is vertically supported by the linear actuator which is supported from the frame.

3. The forming system according to claim 2, wherein the linear actuator is a hydraulic cylinder or a pneumatic cylinder.

4. The forming system according to claim 3, wherein the first and second members are substantially vertically oriented, elongated members and the second member is supported by the linear actuator which is supported by the frame.

5. The forming system according to claim 2, wherein the first and second members are connected to the platform by pivotal connections.

6. The forming system according to claim 5, wherein the first and second members are substantially vertically oriented, elongated members and the second member is supported by the linear actuator which is supported by the frame.

7. The forming system according to claim 2, wherein the first and second members are substantially vertically oriented, elongated members and the second member is supported by the linear actuator which is supported by the frame.

8. The forming system according to claim 1, wherein a forming strip is positioned onto the one forming wall to form around the extending rebar and forms part of the forming surface of the one forming wall.

9. The forming system according to claim 8, wherein when the one forming wall is moved away from the respective other forming wall after the poured concrete between the two forming walls has sufficiently set or cured, the forming strip detaches from the one forming wall and is thereafter stripped off of the first vertical wall course and from around the extending rebar.

10. The forming system according to claim 1, wherein the two forming walls are hung from the frame and the one forming wall is hung with a rolling connection to be translated toward or away from the respective other forming wall.

* * * * *